US009051727B1

(12) United States Patent
Carlton et al.

(10) Patent No.: US 9,051,727 B1
(45) Date of Patent: Jun. 9, 2015

(54) REVERSIBLE PORTABLE MOISTURE REMOVAL SYSTEM

(71) Applicant: ADVANCED MOISTURE SOLUTIONS, LLC, Southlake, TX (US)

(72) Inventors: Wesley Clyde Carlton, Southlake, TX (US); David Laurence Green, Grand Prairie, TX (US)

(73) Assignee: ADVANCED MOISTURE SOLUTIONS, LLC, Southlake, TX (US)

( * ) Notice: Subject to any disclaimer, the term of this patent is extended or adjusted under 35 U.S.C. 154(b) by 0 days.

(21) Appl. No.: 14/444,634

(22) Filed: Jul. 28, 2014

(51) Int. Cl.

| | |
|---|---|
| ***F26B 21/08*** | (2006.01) |
| ***E04B 1/70*** | (2006.01) |
| ***F24D 19/10*** | (2006.01) |
| ***F26B 23/00*** | (2006.01) |

(52) U.S. Cl.
CPC ..... *E04B 1/7015* (2013.01); *F24D 19/1084* (2013.01); *F26B 23/00* (2013.01); *E04B 1/7069* (2013.01)

(58) Field of Classification Search
CPC ..... F26B 19/00; F26B 21/00; F26B 21/08; F26B 25/00; F26B 25/08; E04B 1/00; E04B 1/70
USPC ..... 34/60, 103, 104; 134/56 R, 57 R
See application file for complete search history.

(56) References Cited

U.S. PATENT DOCUMENTS

| | | | | |
|---|---|---|---|---|
| 2,703,911 | A * | 3/1955 | Griffin | 52/302.3 |
| 4,534,119 | A * | 8/1985 | Glicksman | 34/95 |
| 5,155,924 | A * | 10/1992 | Smith | 34/443 |
| 5,408,759 | A * | 4/1995 | Bass | 34/104 |
| 5,555,643 | A * | 9/1996 | Guasch | 34/443 |
| 5,893,216 | A | 4/1999 | Smith et al. | |
| 5,960,556 | A * | 10/1999 | Jansen | 34/402 |
| 6,647,639 | B1 | 11/2003 | Storrer | |
| 6,691,427 | B1 * | 2/2004 | Fernandes et al. | 34/60 |
| 6,886,271 | B2 | 5/2005 | Storrer | |
| 7,047,664 | B1 * | 5/2006 | Martinez | 34/380 |
| 7,357,831 | B2 * | 4/2008 | Dancey et al. | 96/400 |
| 8,006,407 | B2 * | 8/2011 | Anderson | 34/381 |
| 8,256,135 | B2 * | 9/2012 | Hedman | 34/381 |
| 8,468,716 | B1 * | 6/2013 | Walker et al. | 34/435 |

FOREIGN PATENT DOCUMENTS

| | | | | |
|---|---|---|---|---|
| GB | 1369567 | A * | 10/1974 | |
| JP | 05331872 | A * | 12/1993 | E02D 31/06 |

* cited by examiner

*Primary Examiner* — Steve M Gravini
(74) *Attorney, Agent, or Firm* — Buskop Law Group, PC; Wendy Buskop

(57) ABSTRACT

A reversible portable moisture removal system for drying a structure or wall cavity without creating holes in the structure or wall cavity. The system has a moisture removal housing, which comprises an intake means, a blower, an air heater, a pressure controller and an outlet port. The system also has a docketing station connected to a flexible conduit for flowing pressurized heated air at a targeted location and for creating a vacuum to withdraw moist air from the structure or wall cavity to the moisture removal housing.

18 Claims, 4 Drawing Sheets

REVERSIBLE PORTABLE MOISTURE REMOVAL SYSTEM

FIELD

The present embodiments generally relate to a reversible portable moisture removal system for drying a structure or wall cavity without creating holes in the wall or structure.

BACKGROUND

A need exists for a system to rapidly dehumidify a building without damaging, modifying or destroying a building structure or any of its parts. This system will drastically reduce both the cost and the time needed to restore a building after water damage.

A further need exists for reducing the impact on business interruption during the drying process.

The present embodiments meet these needs.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE EMBODIMENTS

Before explaining the present system in detail, it is to be understood that the system is not limited to the particular embodiments and that it can be practiced or carried out in various ways.

The present embodiments generally relate to a reversible portable moisture removal system for drying a structure or wall cavity without creating holes in the walls or structure.

The reversible portable moisture removal system enables fast drying of walls without the need to tear open, make holes, or tear drywall.

The reversible portable moisture removal system is usable without removing sheet rock enabling a business to continue to operate while the wall is being dried. No dust, no cutting, no mess is achieved while drying with minimal noise.

The remote control feature of this invention allows an operator to stand a safe distance away from a structure needing to be dried, such as a structure in a nuclear facility with radiation that might harm the operator. Similarly, if drying of mold is needed in order to safely remove construction or building materials, the operator can dry the mold a safe distance away without breathing the toxic, noxious material that could be harmful to the operator.

The unit, being portable can be quickly deployed in the event of a hurricane, a tornado, a terrorist event, fire, or any other disaster that includes the release or impact of water.

Typically with conventional methods, it can take from 5 to 10 days to dry a wall with existing methodologies and ordinary equipment and blowers.

Figure 1:
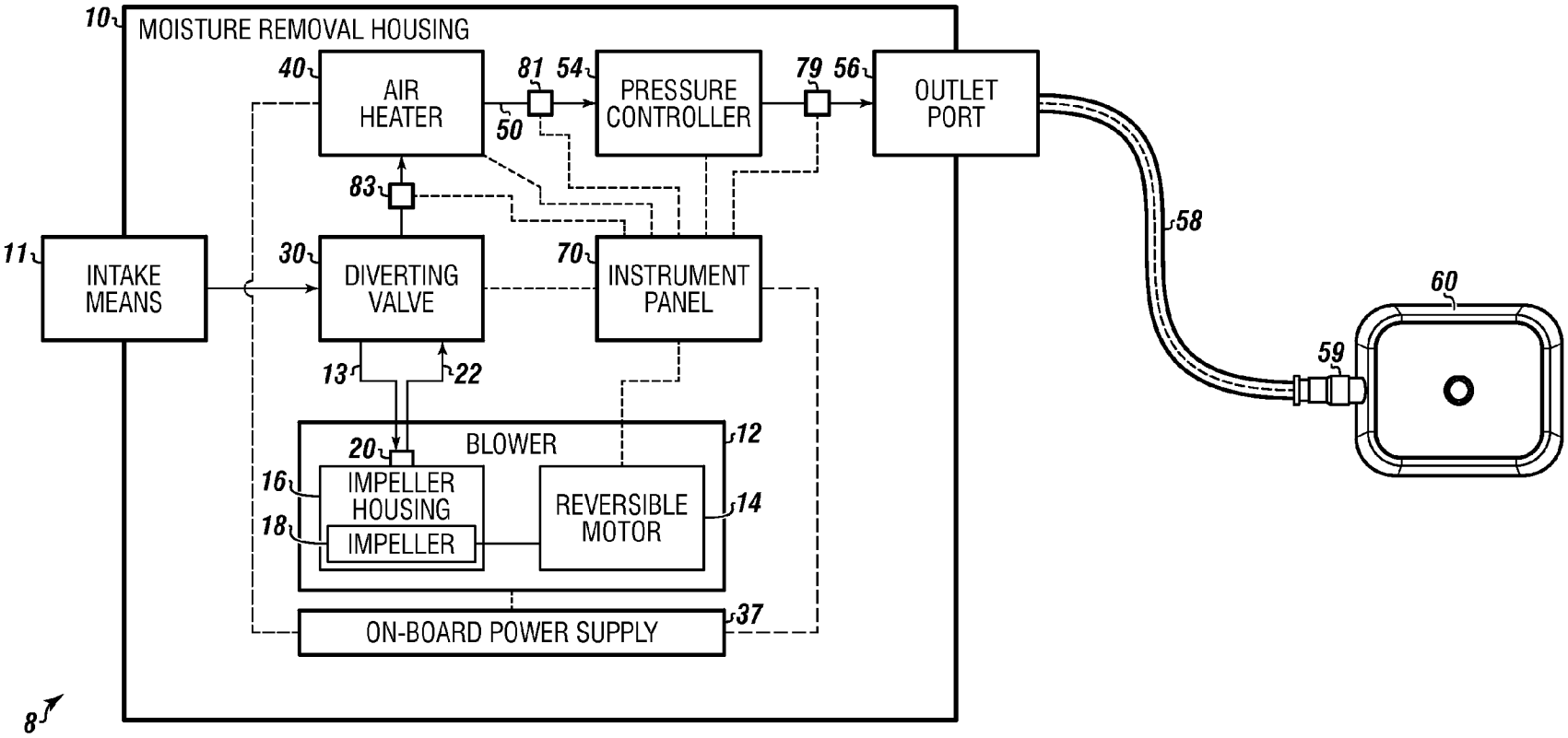
FIG. 1 is a diagram of an overview of the system.

Turning now to the Figures, FIG. 1 is a diagram of an overview of the system.

The reversible portable moisture removal system 8 for drying a structure or wall cavity without creating holes in the wall or structure has a moisture removal housing 10.

The moisture removal housing 10 can be made from durable plastic or formed metal, such as steel or aluminum.

In embodiments, the moisture removal housing can have a size from 40 inches to 60 inches in height and 18 inches to 30 inches in width. Additional sizes can be used depending upon the job size and structure.

In embodiments, the moisture removal housing with all the electronics can weigh from 70 pounds to 150 pounds.

In the system, an intake means 11 can receive atmospheric air 13 into the moisture removal housing 10.

In embodiments, the intake means can be an air intake, a valve, or a closable port. The intake means can have a diameter from 1 inch to 3 inches.

In embodiments, the intake means 11 can be an air filter, a silencer, or both an air filter and a silencer.

A blower 12 can be installed in the moisture removal housing 10 for receiving the atmospheric air 13 from the intake means 11.

In a different configuration, the atmospheric air can flow first to a diverting valve 30, then to the blower 12 and then a pressurized air stream 22 from the blower 12 can flow back to the diverting valve 30.

In still another configuration, the atmospheric air 13 can flow directly to the blower 12 to be pressurized then the pressurized air stream 22 can flow to the diverting valve 30 and then to an air heater 40.

The blower 12 can have a reversible motor 14. In embodiments, the reversible motor can weigh 63 pounds.

Examples of reversible motors 14 can be any known in the industry that can blow in one direction and suck in another direction. In an embodiment, the reversible motor can be a variable speed motor.

The reversible motor can operate at 1 to 3 horsepower (hp) blowing at a velocity from 0.05 feet per minute to 6850 feet per minute.

The reversible motor can run on batteries, a fuel cell, or an onboard power supply 37. In embodiments, the reversible motor can connect to a 110 volt current, such as from a wall plug of the structure.

In embodiments, the reversible motor 14 can communicate with an impeller 18 that can be located within an impeller housing 16 adjacent the reversible motor 14.

The impeller 18 in the impeller housing 16 can have from 36 blades to 56 blades.

In embodiments, the impeller can be made from steel or lightweight aluminum.

An impeller inlet 20 can draw atmospheric air 13 to the impeller housing enabling the impeller to pressurize the atmospheric air 13 and create the pressurized air stream 22.

The pressurized air stream 22 is pressurized to a very low pressure, as measured by a manometer from 0.5 inches of water to 75 inches of water.

In embodiments, the diverting valve 30 can flow the pressurized air stream 22 to the air heater 40 through a flow meter 83. If no diverting valve is used, the pressurized air stream 22 can flow directly to the air heater 40 through the flow meter 83.

In embodiments, the diverting valve can be electrically operable and when the diverting valve is electrically operable, the diverting valve connects to the onboard power supply.

The air heater 40 can be an electric powered resistance air heating unit or a heat exchanger for receiving the pressurized air stream 22.

The air heater 40 heats the air to a temperature from ambient to 200 degrees Fahrenheit.

The air heater 40 can form pressurized heated air 50 with the same pressure as the pressurized air stream 22. A constant pressure continues from the blower to an outlet port 56.

A pressure controller 54, which can be located in the moisture removal housing 10, receives the pressurized heated air 50 and maintains the pressurized heated air 50 within a preset temperature range which is controlled by instruments on an instrument panel 70.

Figure 2:
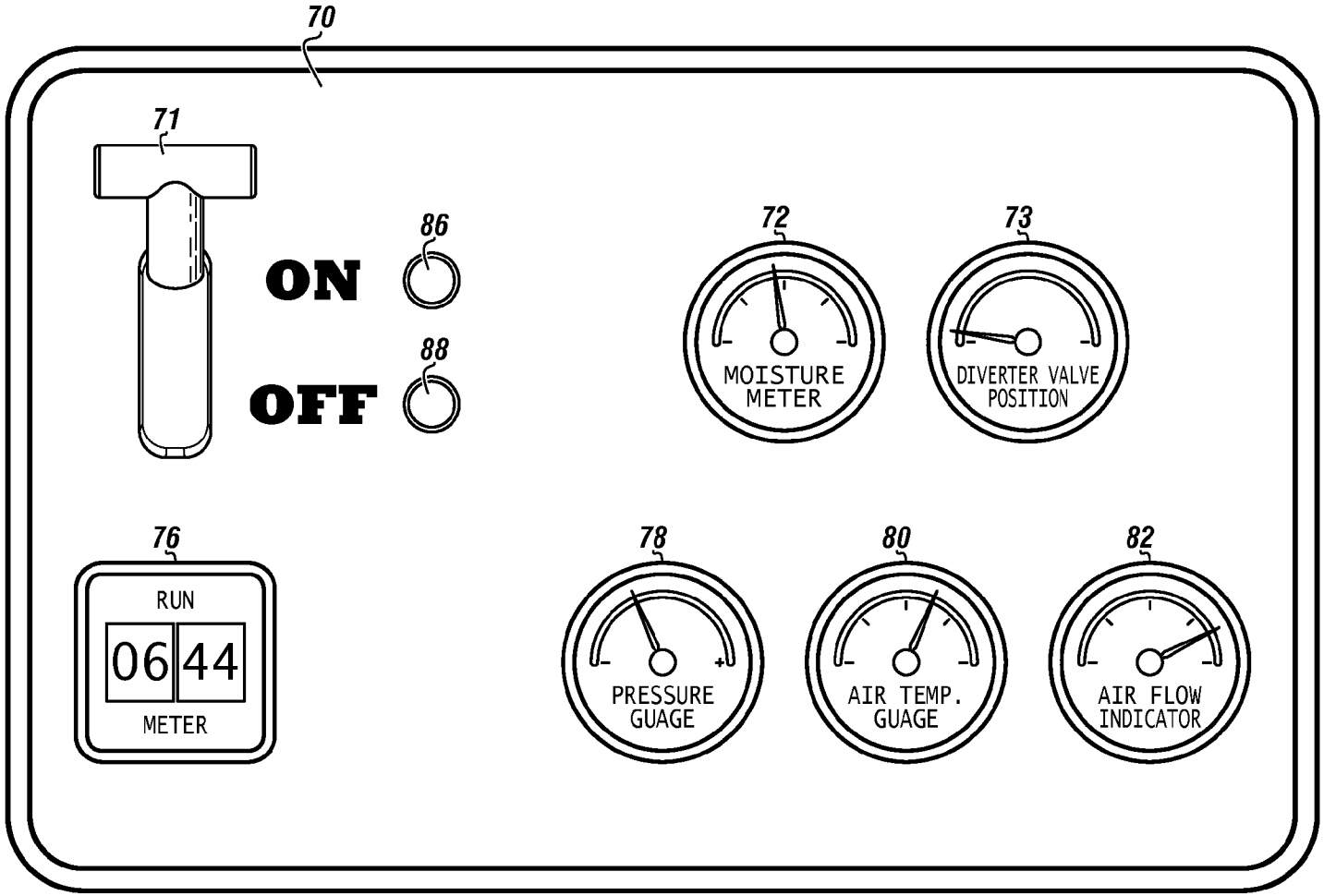
FIG. 2 is a detailed view of an instrument panel usable with the system.

The pressurized heated air 50 can be flowed past a temperate sensor 81, which can be connected to an air temperature gauge 80 shown in FIG. 2, for monitoring temperature of the pressurized heated air 50.

In embodiments, the air pressure controller 54 can flow the pressurize heated air 50 past a pressure sensor 79 connected to a pressure gauge 78, which is shown in FIG. 2, in the instrument panel 70.

The pressure sensor 79 is used for tracking pressure of the pressurized heated air 50 once it leaves the pressure controller 54. The pressure sensor 79 is placed in the pressurized heated air 50 stream.

The pressure controller 54 can regulate blowing pressures and vacuum sucking pressures in sequence. An exemplary pressure controller can be a Dwyer pressure controller.

The pressure controller 54 can flow the pressurized heated air 50 to the outlet port 56 for distribution of the pressurized heated air such as to a docking station 60.

A flexible conduit 58 can connect the outlet port 56 to flow the pressurized heated air 50 away from the moisture removal housing 10 or to flow ambient air from the structure or wall cavity into the moisture removal housing 10.

The docking station 60 can attach to the structure or wall without creating holes in the structure or wall and without using suction cups for flowing the pressurized heated air 50 from the flexible conduit 58 at a targeted location on the structure in the wall cavity.

A quick disconnect 59 can be mounted to the flexible conduit 58 enabling a quick removal or quick attaching to the docking station 60.

In embodiments, the onboard power supply 37 can be connected to the instrument panel 70, the blower 12, the pressure controller 54, and the air heater 40.

FIG. 2 is a detailed view of an instrument panel 70 usable with the reversible portable moisture removal system.

The instrument panel 70 can have an on/off switch 71 for operating the blower, turning on power to the instrument panel and powering the air heater.

The instrument panel 70 can have a moisture meter 72 enabling a user to view changes in moisture content of the pressurized air stream.

The instrument panel 70 can have a diverter valve position gauge 73 for showing if the diverting valve is used, if the diverting valve is in a vacuum sucking position or a blowing pressurized air position.

The instrument panel 70 can have a run meter 76 for tracking time the reversible motor is in operation.

The instrument panel can have a pressure gauge 78, which can display positive and negative pressure of the pressurized heated air as detected by the pressure sensor disposed in the pressurized heated air flow.

The instrument panel 70 can have an air temperature gauge 80, which can display the temperature of the pressurized heated air as sensed by the temperature sensor disposed between the air heater and the pressure controller.

The instrument panel 70 can have an air flow indicator 82, which can be connected to the flow meter which is positioned to monitor flow rates of the pressurized heated air in the moisture removal housing between the blower and the air heater.

In embodiments, the instrument panel can have a green light 86 and a red light 88 indicating the operating status of the reversible motor.

Figure 3:
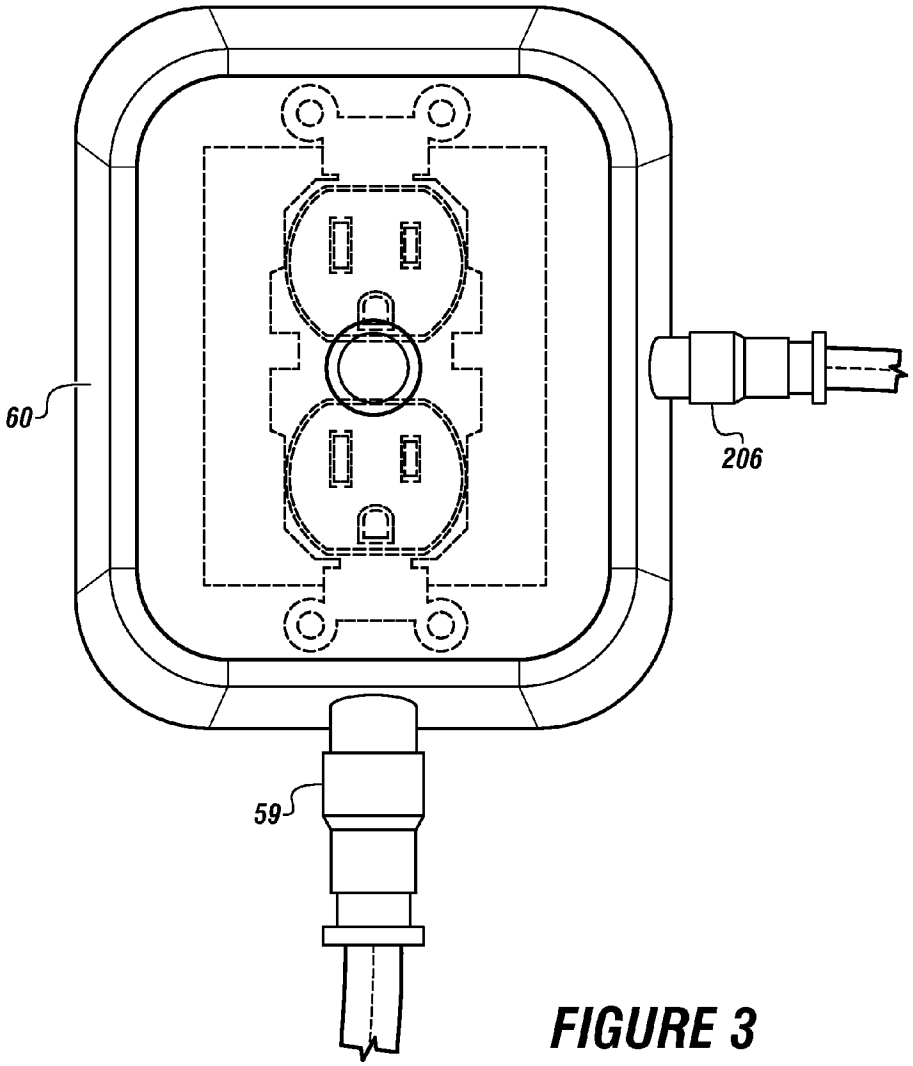
FIG. 3 is a detail of the docking station usable in the system.

FIG. 3 is a detail of the docking station 60 usable in the system.

In this Figure, the docketing station 60 can be mounted in phantom lines to an electrical outlet box typically appearing in the walls of most houses and facilities.

The quick disconnect 59 is shown enabling a quick removal or quick attaching to the docking station 60.

Figure 4:
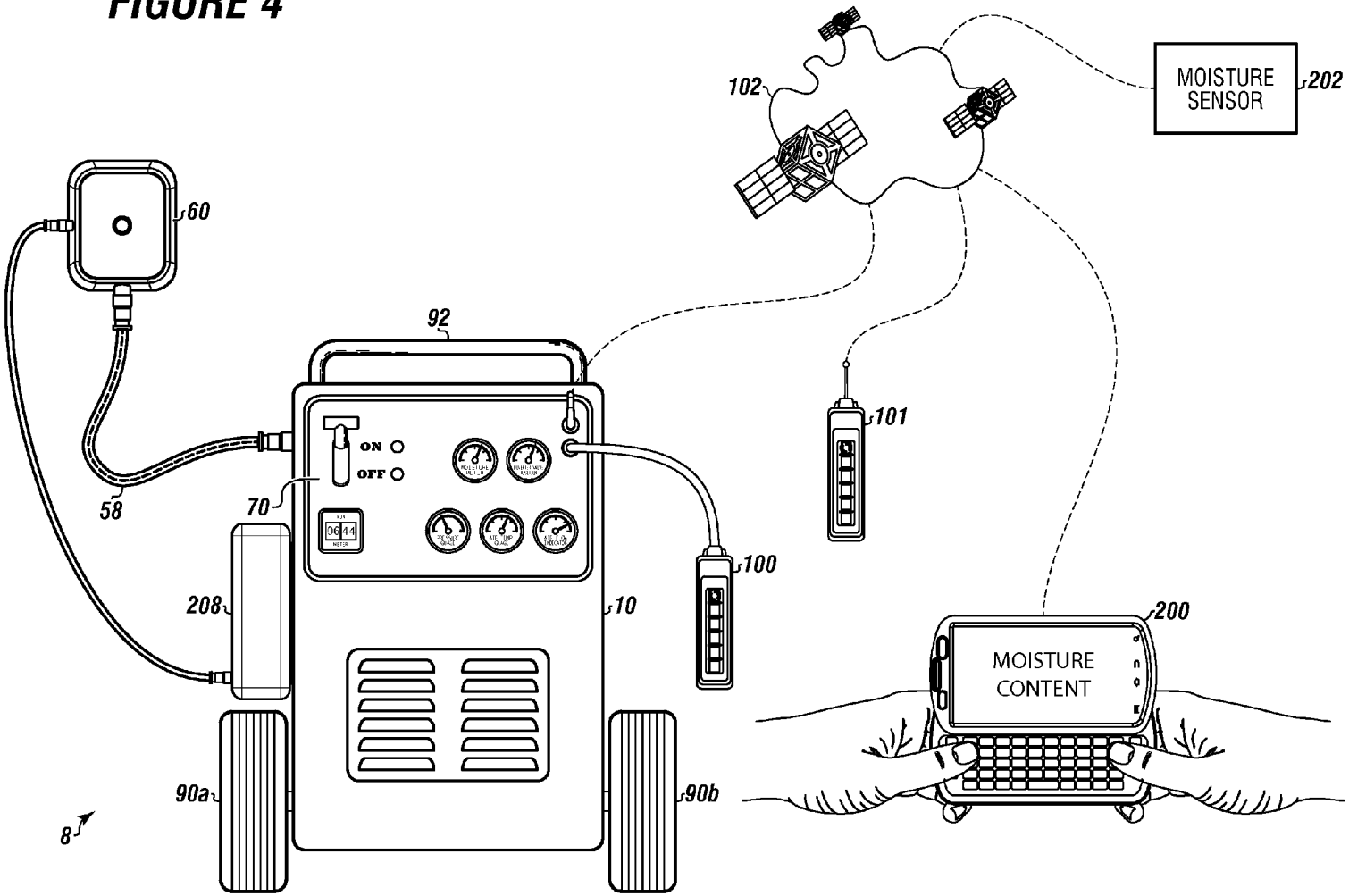
FIG. 4 shows an embodiment of the system connected to a network and at least one client device.

In embodiments, a gas injector 206 can be mounted in the docking station 60 for injecting a gas from a gas reservoir 208, which is shown in FIG. 4, into the wall cavity, structure or facility simultaneously in parallel with the pressurized heated air.

In embodiments, the gas can be ozone, argon, helium, nitrogen, carbon dioxide, or combinations thereof.

FIG. 4 shows an embodiment of the system connected to a network.

The moisture removal housing 10 is shown mounted between a wheel 90*a* and wheel 90*b*. In embodiments, wheels 90*a* and 90*b* can be rotatably secured to the moisture removal housing 10.

In embodiments, a handle 92 can be attached to the moisture removal housing 10. The handle 92 can be "u" shaped for lifting and repositioning the moisture removal housing.

In embodiment, a pendant control station 100 can be used in the system. In embodiments, the pendant control station 100 can be hard wired and can act as a remote control.

The pendant control station 100 can contain a copy of each of the components on the instrument panel 70 and act identical to the instrument panel 70.

The pendant control station 100 (i) provides simultaneous dual monitoring of the reversible portable moisture removal system, and (ii) can control the instrument panel from a remote location.

In embodiments, a wireless remote control device 101 can be in communication with a network 102 for simultaneous monitoring by at least one client device 200.

The wireless remote control device 101 can be used for controlling the instrument panel 70 to additionally (i) provide simultaneous dual monitoring of the reversible portable moisture removal system, and (ii) to control the instrument panel from a remote location without being hard wired.

The reversible portable moisture removal system 8 shows a moisture sensor 202 that can be placed adjacent the structure or wall cavity. In embodiments, the moisture sensor 202 can be in wireless communication with the at least one client device 200, the wireless remote control device 101, or both the at least one client device and the wireless remote control device.

The moisture sensor 202 can communicate wirelessly with the network 102 to display moisture content on at least one client device 200. The at least one client device 200 can display changes in moisture content of the pressurized air stream.

The gas injector can be mounted in the docking station 60 connected to the flexible conduit 58 for injecting a gas from a gas reservoir 208 mounted to the moisture removal housing 10. The gas can be injected into the structure or the wall cavity simultaneously in parallel with the pressurized heated air.

In embodiments, a plurality of reversible portable moisture removal systems can be used. The plurality of reversible portable moisture removal systems can all be connected to the network enabling simultaneous viewing of multiple systems by multiple client devices connected to the network.

To understand the system, the following series of steps describes an exemplary use.

The operator wheels the reversible portable moisture removal system to within 1 to 15 feet of the structure or wall cavity to be dried. The unit is light enough that a single person can easily move the unit.

To dry the structure or wall cavity, an operator first removes either (i) a light switch cover mounted to a wall, or (ii) a power outlet cover mounted to a wall.

The operator takes the docking station of the system and using fasteners, such as a long screw, attaches the docking station into at least one of the screw holes that hold the light switch cover or the power outlet cover to the light switch box in the wall or the power outlet box in the wall.

The operator then verifies that if the diverting valve is used, the diverting valve of the system is either in (i) a vacuum operating condition or (ii) a pressure operating condition.

The operator then places the diverting valve into the operating condition desired depending on which type of air motion the operator desires to impact the wall or structure.

The operator then sets a pressure for the pressurized heated air to ensure the pressurized heated air is maintained within preset limits.

The operator uses either (i) the instrument panel mounted on the system, (ii) a pendant control station hardwired to but geographically apart from the instrument panel or (iii) a wireless remote control device remote from the reversible portable moisture removal system but in communication with the instrument panel of the system to switch on the reversible portable moisture removal system.

The operator then sets an air temperature desired for pressurized heated air using an air temperature sensor connected to an air temperature gauge. The air temperature gauge can be mounted on the instrument panel.

The gauges can contain setpoints which enable the entire moisture removal process to be automated once the system is turned on.

In embodiments, the system can be completely automated where the wireless remote controls actuate the system.

The operator, if no setpoint is used, monitors the air temperature gauge to ensure the air temperature is within the operator set preset limits.

In embodiments, a computer connected to the network can monitor the air temperature, moisture gauges and pressure gauges and automatically shut down the system when the temperatures, pressures and moisture levels exceed or drop below preset limits.

The operator then monitors the pressure gauge to ensure the pressure of the pressurized heated air is within the operator preset limits.

The operator also monitors the air flow indicator using signals from the flow meter positioned to monitor the flow rates of the pressurized heated air to ensure the air is flowing into the docking station within defined flow rates.

The operator can monitor the run meter to ensure routine maintenance is performed.

While these embodiments have been described with emphasis on the embodiments, it should be understood that within the scope of the appended claims, the embodiments might be practiced other than as specifically described herein.

What is claimed is:

1. A reversible portable moisture removal system for drying a structure or wall cavity without creating holes in the structure or wall cavity, the reversible portable moisture removal system comprising:

a. a moisture removal housing;
   (i) an intake means for receiving atmospheric air, the intake means disposed in the moisture removal housing;
   (ii) a blower disposed in the moisture removal housing for receiving atmospheric air from the intake means, the blower comprising:
      1. a reversible motor;
      2. an impeller housing adjacent the reversible motor;
      3. an impeller in the impeller housing, wherein the impeller is connected to the reversible motor; and
      4. an impeller inlet for drawing atmospheric air to the impeller housing enabling the impeller to pressurize the atmospheric air and create a pressurized air stream, the pressurized air stream is pressurized from 0.5 inches of water to 75 inches of water as measured by a manometer;
   (iii) an air heater for receiving the pressurized air stream from the impeller housing and heating the pressurized air stream to a temperature from an ambient temperature to 200 degrees Fahrenheit forming a pressurized heated air;
   (iv) a pressure controller in the moisture removal housing for maintaining the pressurized heated air within a preset temperature range; and
   (v) an outlet port for distribution of the pressurized heated air;

b. a flexible conduit connected to the outlet port for flowing the pressurized heated air away from the moisture removal housing or for flowing ambient air from the structure or wall cavity into the moisture removal housing;

c. a docking station connected to the flexible conduit for attaching to the structure or wall cavity without creating holes in the structure or wall cavity and without using suction cups for flowing the pressurized heated air at a targeted location and for creating a vacuum to withdraw moist air from the structure or wall cavity to the moisture removal housing; and d. an instrument panel in the moisture removal housing, the instrument panel comprising:
   (i) an on/off switch for operating the blower;
   (ii) a pressure gauge tracking pressure of the pressurized heated air using a pressure sensor disposed in the pressurized heated air flow;
   (iii) an air temperature gauge for monitoring temperature of the pressurized heated air using a temperature sensor; and
   (iv) an air flow indicator connected to a flow meter, the flow meter positioned to monitor the pressurized heated air in the moisture removal housing.

2. The reversible portable moisture removal system of claim 1, further comprising: a diverting valve for receiving the pressurized air stream from the impeller housing and atmospheric air from the intake means and the air heater for receiving the pressurized air stream from the diverting valve and in the instrument panel, a diverter valve position indicating operating status of the diverting valve as either blowing air out of the docking station or sucking air into the docking station.

3. The reversible portable moisture removal system of claim 1, comprising a green light and a red light on the instrument panel indicating operating status of the reversible motor.

4. The reversible portable moisture removal system of claim 1, wherein the reversible motor is a variable speed motor.

5. The reversible portable moisture removal system of claim 1, comprising an onboard power supply connected to the instrument panel, the blower, the pressure controller, and the air heater.

6. The reversible portable moisture removal system of claim 2, wherein the diverting valve is electrically operable and when the diverting valve is electrically operable, the diverting valve connects to the onboard power supply.

7. The reversible portable moisture removal system of claim 1, comprising either a filter or a silencer, or both as the intake means.

8. The reversible portable moisture removal system of claim 1, comprising at least one wheel rotatably secured to the moisture removal housing.

9. The reversible portable moisture removal system of claim 1, comprising a handle on the moisture removal housing for lifting the moisture removal housing.

10. The reversible portable moisture removal system of claim 1, comprising a quick disconnect mounted to the flexible conduit enabling a quick removal or a quick attaching to the docking station of the flexible conduit.

11. The reversible portable moisture removal system of claim 1, comprising a pendant control station hardwired to the instrument panel to provide simultaneous dual monitoring of the reversible portable moisture removal system and to control the instrument panel from a remote location.

12. The reversible portable moisture removal system of claim 1, comprising a wireless remote control device in communication with and controlling the instrument panel to provide simultaneous dual monitoring of the reversible portable moisture removal system and to control the instrument panel from a remote location.

13. The reversible portable moisture removal system of claim 12, wherein at least one: the wireless remote control device, a processor, or both the wireless remote control device and the processor further communicates with a network for simultaneous monitoring by at least one client device.

14. The reversible portable moisture removal system of claim 13, comprising connecting a plurality of reversible portable moisture removal systems to the network enabling simultaneous viewing of the plurality of reversible portable moisture removal systems by the at least one client device connected to the network.

15. The reversible portable moisture removal system of claim 1, wherein the instrument panel comprises a run meter for tracking time the reversible motor is in operation.

16. The reversible portable moisture removal system of claim 13, further comprising a moisture sensor adjacent the structure or wall cavity in wireless communication with at least one of:

a. the network with the at least one client device for displaying changes in moisture content of the pressurized air stream; and b. a moisture meter in the instrument panel enabling a user to view changes in moisture content of the pressurized air stream.

17. The reversible portable moisture removal system of claim 1, comprising a gas injector mounted in the docking station for injecting a gas from a gas reservoir into the structure or wall cavity simultaneously in parallel with the pressurized heated air.

18. The reversible portable moisture removal system of claim 17, wherein the gas is ozone, argon, helium, nitrogen, carbon dioxide, or combinations thereof.

* * * * *